US007279013B2

(12) United States Patent
Elgarhy

(10) Patent No.: US 7,279,013 B2
(45) **Date of Patent: *Oct. 9, 2007**

(54) POLYAMIDE FIBER SUBSTRATE HAVING STAIN RESISTANCE, COMPOSITION AND METHOD

(75) Inventor: Yassin M. Elgarhy, Laval (CA)

(73) Assignee: Trichromatic Carpet Inc., St-Eustache, Québec (CA)

( * ) Notice: Subject to any disclaimer, the term of this patent is extended or adjusted under 35 U.S.C. 154(b) by 94 days.

This patent is subject to a terminal disclaimer.

(21) Appl. No.: 10/872,394

(22) Filed: Jun. 22, 2004

(65) Prior Publication Data

US 2004/0229009 A1 Nov. 18, 2004

Related U.S. Application Data

(63) Continuation of application No. 10/099,959, filed on Mar. 19, 2002, now Pat. No. 6,814,881, which is a continuation of application No. 09/465,265, filed on Dec. 17, 1999, now Pat. No. 6,395,655.

(51) Int. Cl.
*B32B 27/30* (2006.01)

(52) U.S. Cl. ..... 8/115.54; 442/93; 442/94; 442/129; 442/166; 525/427; 525/429; 428/96; 252/8.62; 8/127.5

(58) Field of Classification Search ..... 8/115.54, 8/127.5; 442/93, 94, 129, 166; 428/96; 252/8.62; 525/427, 429
See application file for complete search history.

(56) References Cited

U.S. PATENT DOCUMENTS

| | | | | |
|---|---|---|---|---|
| 4,833,009 | A | | 5/1989 | Marshall |
| 5,073,442 | A | * | 12/1991 | Knowlton et al. ..... 442/94 |
| 5,457,259 | A | | 10/1995 | Elgarhy et al. |
| 5,672,674 | A | | 9/1997 | Waltz et al. |
| 5,708,087 | A | * | 1/1998 | Buck et al. ..... 525/136 |
| 5,736,468 | A | | 4/1998 | Elgarhy |
| 5,756,407 | A | | 5/1998 | Elgarhy |
| 6,395,655 | B1 | | 5/2002 | Elgarhy |

FOREIGN PATENT DOCUMENTS

| | | | |
|---|---|---|---|
| CA | 2050518 | | 9/1991 |
| ZA | 9505414 | A * | 9/1997 |

* cited by examiner

*Primary Examiner*—Elizabeth M. Cole
(74) *Attorney, Agent, or Firm*—Ogilvy Renault LLP

(57) ABSTRACT

Semi-bleached to bleached sulfonated aromatic condensation resin alone or in combination with a semi-soluble methacrylic polymer of high molecular weight provides improved resistance to staining by acid colorants in a fibrous polyamide or wool substrate.

21 Claims, No Drawings

POLYAMIDE FIBER SUBSTRATE HAVING STAIN RESISTANCE, COMPOSITION AND METHOD

This application is a continuation of Ser. No. 10/099,959, filed Mar. 19, 2002, now U.S. Pat. No. 6,814,881, which is a continuation of Ser. No. 09/465,265, filed Dec. 17, 1999, now U.S. Pat. No. 6,395,655.

BACKGROUND OF THE INVENTION i) Field of the Invention

This invention relates to a fibrous polyamide or wool substrate having durable resistance to staining by acid colorants and to a method of rendering a fibrous polyamide or wool substrate durably resistant to staining by acid colorants.

ii) Description of Prior Art

Fibrous polyamide substrates, such as nylon carpeting and similar wool substrates are susceptible to staining by both naturally occurring and commercial acid colorants found in many common foods and beverages. The demand for reduced staining from such acid colorants has by and large been met by treatment with compositions comprising sulfonated naphthol or sulfonated phenol-formaldehyde condensation products as disclosed for example in the following patents: U.S. Pat. No. 4,501,591 Ucci and Blyth; U.S. Pat. No. 4,592,940 Blyth and Ucci; U.S. Pat. No. 4,680,212 Blyth and Ucci; U.S. Pat No. 4,780,099 Greshler, Malone and Zinnato; U.S. Pat. No. 4,865,885 Herlant and Al; or by treatment with compositions comprising sulfonated novolak resins together with polymethacrylic acid as disclosed in U.S. Pat. No. 4,822,373 Olson, Chang and Muggli.

The use of polymers or copolymers of methacrylic acid of low weight average molecular weight and low number average molecular weight is described in U.S. Pat. No. 4,937,123 Chang, Olson and Muggli.

The initial stain resistance properties imparted to polyamide or wool substrates, such as carpeting, that have been treated using the above mentioned compositions degenerate, significantly with each wet cleaning the substrate receives. Improved stain resistance after wet cleaning can be achieved by increasing the amount of the sulfonated hydroxy aromatic formaldehyde condensation products, in the stain resist product or by increasing the amount of stain-resist product initially applied to the substrate, however, this generally leads to discoloration caused by yellowing of the substrate initially and further discoloration upon exposure to oxides of nitrogen and/or light.

Stain-resist products currently available in the market place are generally based on dihydroxydiphenyl sulfone and phenol sulfonic acid condensed with an aldehyde in acid or alkaline media, or dihydroxy diphenyl sulfone and naphthalene sulfonic acid condensed with aldehyde in acid or alkaline media.

It is generally known that increasing the ratio of the dihydroxydiphenyl sulfone to the phenol sulfonic acid or naphthalene sulfonic acid increases the stain resistance properties of the resin and subsequently causes a higher degree of yellowing or discoloration initially and further discoloration upon exposure to oxides of nitrogen and/or light.

Conversely it is also evident that when the ratio of phenol sulfonic acid or naphthalene sulfonic acid to dihydroxydiphenyl sulfone increases the result is lower stain-resist properties and less discoloration.

The addition of a methacrylic resin in the form of methacrylic polymers and/or copolymers to the previously mentioned condensation products (novolak resin) as disclosed in U.S. Pat. No. 4,223,473 (Olson, Chang and Muggli ) allows the use of a novolak resin in smaller quantities with larger quantities of the methacrylic resin. With this combination of novolak resin and methacrylic resin, a major improvement in the light fastness or less discoloration is achieved due to the dramatically reduced percentage of novolak resin in the product mentioned above, which is adjusted to obtain a desired low level of discoloration while maintaining an acceptable level of durability to wash. The high level of initial stain resistance is supplied primarily by the methacrylic resin and. after wet cleaning the stain resistance is supposedly maintained by the novolak resin, the methacrylic resin having largely been removed during the wet cleaning process.

SUMMARY OF THE INVENTION

It is an object of this invention to provide fibrous polyamide or wool substrates having durable resistance to staining by acid colorants.

It is further object of this invention to provide a method of rendering a fibrous polyamide or wool substrate durably resistant to staining by acid colorants.

It is still a further object of this invention to provide an aqueous formulation for providing resistance to staining by acid colorants in a fibrous polyamide or wool substrate.

In accordance with one aspect of the invention there is provided a fibrous polyamide substrate having resistance to staining by acid colorants comprising: a fibrous polyamide substrate having applied thereto a semi-bleached to bleached sulfonated aromatic condensation resin, said resin being selected from the group consisting of condensation products of: i) phenolsulfonic acid, dihydroxydiphenyl sulfone and an aldehyde; ii) sulfonated dihydroxydiphenylsulfone, dihydroxydiphenylsulfone and an aldehyde; iii) sulfonated dihydroxy diphenyl sulfone and an aldehyde and iv) mixtures of i), ii) and iii).

In accordance with another aspect of the invention there is provided a method of imparting stain resistance to acid colorants, to a fibrous polyamide substrate comprising: contacting said fibrous polyamide substrate with a semi-bleached to bleached sulfonated aromatic condensation resin in an aqueous vehicle, said resin being selected from the group consisting of condensation products of: i) phenolsulfonic acid, dihydroxydiphenyl sulfone and an aldehyde; ii) sulfonated dihydroxydiphenylsulfone, dihydroxydiphenyl sulfone and an aldehyde; iii) sulfonated dihydroxy diphenyl sulfone and an aldehyde and iv) mixtures of i), ii) and iii).

The condensation product can be applied alone or in combination with: a semi-soluble high molecular weight methacrylic acid polymer and optionally also a semi-soluble to insoluble high molecular weight ethyl methacrylate polymer.

In accordance with another aspect of the invention there is provided an aqueous formulation for providing resistance to staining by acid colorants in a fibrous polyamide substrate comprising in an aqueous vehicle: a) a semi-bleached to bleached sulfonated aromatic condensation resin, said resin being selected from the group consisting of condensation products of: i) phenolsulfonic acid, dihydroxydiphenyl sulfone and an aldehyde; ii) sulfonated dihydroxydiphenyl sulfone, dihydroxydiphenyl sulfone and an aldehyde; iii) sulfonated dihydroxy diphenyl sulfone and an aldehyde and iv) mixtures of i), ii) and iii) and b) a semi-soluble methacrylic acid polymer of high weight average molecular weight and high number average molecular weight.

DETAILED DESCRIPTION OF THE INVENTION i) Condensation Resin

The invention employs a semi-bleached to bleached sulfonated aromatic condensation resin.

The condensation resin may be a condensation product of phenol sulfonic acid, dihydroxy diphenyl sulfone and an aldehyde; or a sulfonated condensation product of dihydroxy phenyl sulfone, sulfonated dihydroxy phenyl sulfone and an aldehyde; or a sulfonated dihydroxy phenyl sulfone and an aldehyde.

The aldehyde is suitably formaldehyde or a lower alkyl aldehyde in which the lower alkyl moiety has 1 to 6, preferably 1 to 4 carbon atoms.

The condensation may be carried out in acid or alkaline media.

The dihydroxydiphenyl sulfone may, in particular, be 4,4-dihydroxyphenyl sulfone; and similarly the sulfonated dihydroxydiphenyl sulfone, may be sulfonated 4,4-dihydroxyphenyl sulfone.

A unit of the condensation product of phenol sulfonic acid, 4,4-dihydroxy diphenylsulfone and formaldehyde may be represented by formula (I):

(I)

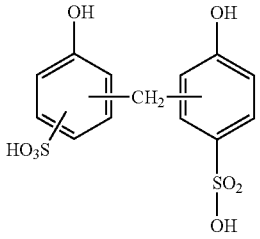

A typical unit of the condensation product of 4,4-dihydroxydiphenylsulfone, sulfonated 4,4-dihydroxydiphenylsulfone and formaldehyde may be represented by formula (II):

(II)

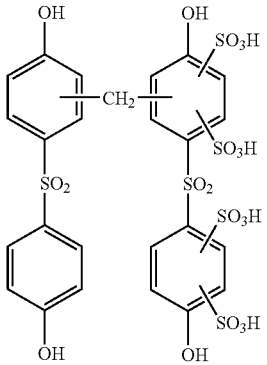

The sulfonated 4,4-dihydroxydiphenylsulfone employed in the above unit is double sulfonated, by which is meant that on average each phenyl of the 4,4-dihydroxydiphenylsulfone has two sulfonate or sulfonic acid substituents.

A typical unit of the condensation product of sulfonated 4,4-dihydroxydiphenylsulfone and formaldehyde may be represented by the formula (III):

(III)

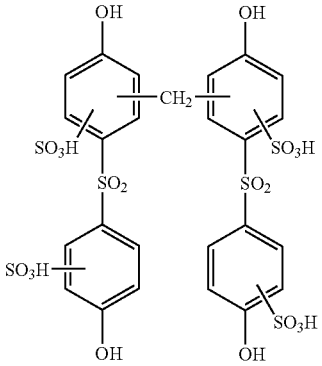

The sulfonic acid groups increase the solubility of the condensation products.

The condensation resin may comprise one or more of the condensation resins of the afore-mentioned three classes such as represented by (I), (II) and (III).

Optionally the semi-bleached to bleached condensation resin of the invention may be employed in conjunction with a bleached aldehyde condensate of a sulfonated naphthalene, such as described in U.S. patent application Ser. No. 09/410,082, filed Oct. 1, 1999, Y. Elgarhy et al. In particular-, such condensates are condensates of a naphthalene sulfonic acid, for example, a mono-, di, or tri-sulfonic acid, such as naphthalene-2-monosulfonic acids, an aldehyde especially formaldehyde and a dihydroxydiphenyl sulfone, for example, 4,4-dihydroxydiphenylsulfone. The condensation may be in acid or alkaline media.

The above condensation products are bleached or semi-bleached to remove or reduce colour which causes the yellowing of nylon fibres, by techniques known in the art. By way of example the condensate may be bleached by addition of 0.1 to 4%, by weight, sodium or zinc formaldehyde sulfoxylate for a period of 20 to 90 minutes at a temperature below 100° C. This typically reduces colour by 20 to 80% and prevents further discoloration. The bleaching or partial stripping of color is preferably carried out at a pH higher than 7 when sodium formaldehyde sulfoxylate is employed, and at a pH lower than 7 when zinc formaldehyde sulfoxylate is employed, and at a temperature of 50° C. or higher. The reference to bleaching, stripping or partially removing color herein refers to removal of the part of the color in the condensate which causes the yellowing of the fibrers, bleaching, stripping or partial removal of color results in the condensate becoming lighter in color.

The degree of bleaching or stripping depends upon the condensate and whether it is condensed at acid or alkaline media; and also depends on the stripping agent whether it is sodium or zinc, formaldehyde sulfoxylate, and the bleaching or stripping conditions, for example, pH.

The time and the temperature are important factors and the percentage of stripping of the color varies, according to the stripping conditions, between 20 to 80%.

After the bleaching or stripping, even if the color is still dark, it is observed that yellowing of the fibers does not occur.

The amounts of the semi-bleached to bleached sulfonated aromatic condensation resin and the optional bleached aldehyde condensate of a sulfonated naphthalene deposited from an aqueous formulation on the polyamide substrate is dependent on the process employed for the deposition, as is well understood by persons in the art, and thus persons in the art will well understand the concentrations required in the aqueous formulation, based on the application technique and method parameters employed.

The aqueous formulation is applied to the fibrous substrate by conventional procedures, for example, the substrate may be immersed in a bath of the aqueous formulation, or the formulation may be exhausted onto the substrate by foam system or spray or applied in one step with fluorochemical. Suitably, the treated substrate is rinsed with water and dried. The treated substrate retains the deposited resins.

Suitably the resins are applied to the polyamide fibre substrate in an aqueous vehicle at a pH of 1 to 10.

ii) Methacrylic Polymers

Methacrylic acid polymers and methacrylate polymers referred to herein contemplates homopolymers as well as copolymers with one or more comonomers.

These methacrylic acid and methacrylate polymers are optionally employed in conjunction with the condensation resin.

Suitable polymers include semi-soluble methacrylic acid polymers; and semi-soluble or insoluble ethylmethacrylate polymers.

Completely soluble acrylic and methacrylic homopolymers and copolymers do not have durability to wet cleaning, so that their stain resist effect diminishes with wet cleaning; whereas completely insoluble acrylic resins have very little stain resist effect on polyamide fibers.

The present invention preferably employs one or more lower solubility methacrylic acid and methacrylate polymers which are resistant to wet cleaning processes thereby providing durable stain resistance, while providing initial stain resistance, prior to wet cleaning of a polyamide fiber substrate, as well as a soil release effect, and a substantial improvement in the light fastness.

The semi-soluble methacrylic acid polymer, is suitably a homopolymer of methacrylic acid or a copolymer of methacrylic acid and at least one comonomer, for example, ethyl acrylate, 2-ethylhexyl methacrylate, ethyl methacrylate, methyl methacrylate, butyl methacrylate or isobutyl methacrylate.

The methacrylic acid polymer suitably has a high weight average molecular weight of at least 100,000, typically 100,000 to 500,000, and preferably 150,000 to 250,000 preferably over 200,000; and a high number average molecular weight of at least 50,000, typically 50,000, to 100,000, and preferably 50,000 to 80,000, and more preferably 60,000 to 75,000.

Suitably the semi-soluble or insoluble ethyl methacrylate polymer is a homopolymer of ethyl methacrylate or a copolymer of ethyl methacrylate and at least one comonomer, for example, ethyl acrylate, methyl acrylate, methyl methacrylate, methacrylic acid, butyl methacrylate, isobutyl methacrylate or 2-ethyl hexyl methacrylate.

The ethyl methacrylate polymer suitably has a high weight average molecular weight of at least 100,000, typically 100,000 to 500,000, and preferably 100,000 to 250,000, and a high number average molecular weight of at least 25,000 to 100,000 and preferably 35,000 to 70,000.

The ethyl methacrylate polymer and the methacrylic acid polymer, when employed, together with semi-bleached to bleached sulfonated aromatic condensation products and the optional bleached aldehyde condensate of a sulfonated naphthalene, are applied to the polyamide fiber substrate in an aqueous vehicle in which the polymers, condensation products and aldehyde condensate, are mixed in water.

An aqueous formulation of the methacrylic acid polymers and the sulfonated aromatic condensation products, for treating a polyamide substrate, typically contains an amount of the methacrylic acid polymer to deposit on the polyamide substrate of Nylon 66 at least 0.1%, by weight, and at least 0.3%, by weight, on Nylon 6.

The sulfonated aromatic condensation products of this invention are typically employed in the formulation in an amount to deposit at least 0.03%, by weight, on Nylon 66 substrate and at least 0.1%, by weight, on Nylon 6 substrate, based on the weight of the substrate.

The amounts of suitable methacrylic polymers and the semi-bleached to bleached aromatic condensation products of this invention, and the optional bleached aldehyde condensate, deposited from the aqueous formulation on the polyamide fibre substrate is dependent on the process employed for the deposition; as is well understood by persons in the art, and thus persons in the art will well understand the concentration required in the aqueous formulation, based on the application technique and method parameters employed.

The aqueous formulation is applied to the fibrous substrate by conventional procedures for example, the substrate may be immersed in a bath of the aqueous formulation, or the formulation may be exhausted onto the substrate by foam system or spray or applied in one step. Suitably, the treated substrate is rinsed with water and dried.

The treated substrate retains the deposited polymers, condensation products and aldehyde condensate on the fibers.

In a preferred embodiment an anionic or non-ionic fluorochemical is also applied to the substrate. The fluorochemical can be applied from a single bath containing the other components to be deposited, or may be deposited from a separate bath.

In a particular embodiment there is deposited on Nylon 66 one, two or three of the three classes of semi-bleached to bleached sulfonated aromatic condensation resins of the invention, in an amount of at least 0.1%, based on the weight of the substrate; together with at least 0.2%, based on the weight of the substrate, of the methacrylic acid polymer; and 0 to 3% based on the weight of the substrate, of the ethylmethacrylate polymer.

In another particular embodiment there is deposited on Nylon 6 one, two or three of the three classes of semi-bleached to bleached sulfonated aromatic condensation resins of the invention, in an amount of at least 0.1%, by weight, based on the weight of the substrate; together with at least 0.3%, by weight, based on the weight of the substrate, of the methacrylic acid polymer; and 0% to 4%, by weight, based on the weight of the substrate, of the ethylmethacrylate polymer.

The methacrylic acid polymer is suitably deposited from an aqueous vehicle at an acidic pH below 7.

DESCRIPTION OF PREFERRED EMBODIMENTS

Polymer A)

In a clean reactor vessel the following were added:

Mix No. 1

92.36 parts by weight of water and 0.14 parts by weight of ammonium persulfate.

3 parts of dodecyl benzene sulfamic acid (sodium salt at 30% solid) The solution was heated to 90° C. and maintained at this temperature at all times with continued agitation.

Mix No. 2

In a separate tank the following were added in parts by weight.

57.2 water-29.6 methacrylic acid-3 parts 2 ethyl hexyl methacrylate-and another addition of ammonium persulfate was added to obtain the mole weight required.

Mix No. 2 was added slowly to Mix No. 1 while maintaining temperature of 90° C. at all times, after the last addition the temperature was raised to 95° C. and the reaction was continued for 90 minutes then cooled down to 30° C.

The above reaction resulted in an anionic hazy solution with high viscosity and a solid content of 18 to 19%, by weight.

The resultant methacrylic acid copolymer had a weight average molecular weight of 210,000, and a number average molecular weight of 70,000, and is referred to in the Examples as Polymer A.

Polymer B)

To a clean reaction vessel equipped with mechanical stirrer to produce efficient agitation the following was charged as for Mix No. 1, in parts, by weight: 85.8 parts water and 2.2 parts ammonium persulfate 3.52 parts dodecyl benzene sulfonic acid sodium salt. The above solution was heated to 80° C. and maintained at this temperature.

In a separate tank the following were charged as Mix No. 2: 0.7 ethyl acrylate-3.52 parts methyl methacrylate 6.6 parts methacrylic acid, 45 parts water 26.4 parts ethyl methacrylate then finally another addition of ammonium persulfate was added to obtain the mole weight required.

Mix No. 2 was added slowly to mix no. 1 while maintaining the temperature at 80° C. After the last addition the reaction continued for 90-120 minutes at 80-90° C., followed by cooling to 30° C. The reaction produced an anionic milky emulsion with approximately 25 to 26%, by weight, solid content. The resultant ethyl methacrylate copolymer had a weight average molecular weight of 110,000, and a number average molecular weight of 36,000, and is referred to in the Examples as Polymer B.

The manufacturing of semi-bleached to bleached sulfonated aromatic formaldehyde condensation resins is as follows:

Condensation Product C

This product can be manufactured in different ways, however, the most important factor is the bleaching of the final product which makes the difference between the unbleached condensation product and the bleached product.

First Method:

4,4-Dihydroxy diphenyl sulfone was sulfonated by treatment with concentrated sulfuric acid over several hours at a temperature of 100° C. or higher with a level of double sulfonation on each mole of 4,4-dihydroxy diphenyl sulfone. The sulfonated 4,4-dihydroxydiphenyl sulfone was mixed with 4,4-dihydroxy diphenyl sulfone at a ratio of 70 to 30 and the mixture was condensed with formaldehyde at a pH below 7 for several hours at a temperature of 100-110° C., the ratio of the aromatic compounds and the formaldehyde being adjusted at 1 mole aromatic compound to 0.55 moles of formaldehyde.

After the reaction the condensation product was cooled down to 70° C. add bleached with 1.5% zinc formaldehyde sulfoxylate at this temperature, for 60 minutes. This produces a product with type II units as described hereinbefore.

Second Method:

The product also can be manufactured by a different method as follows:

4,4-Dihydroxydiphenyl sulfone was sulfonated by concentrated sulfuric acid at a temperature around 100° C. for several hours, to produce sulfonation ratio around 1:1 to obtain acceptable solubility, then the sulfonated 4,4-dihydroxy diphenyl sulfone was condensed with formaldehyde over several hours at about 100° C. at a ratio of 1 mole sulfonated 4,4-dihydroxydiphenol sulfone to 0.7 to 0.8 moles of formaldehyde. The condensation product was cooled down to 70° C. and bleached with 1.5% zinc formaldehyde sulfoxylate for about 60 minutes.

Condensation Product D

A second condensation product of this invention can be made as follows: phenol sulfonic acid/dihydroxy diphenyl sulfone were dissolved in water then condensed with formaldehyde several hours at a pH between 3 to 10, at a temperature between 105° C. and 130° C. The product which is evaluated in this invention is made as follows:

The molecular ratio of the phenol sulfonic acid to the dihydroxy diphenyl sulfone was 55:45.

The molecular ratio between the above mix and the formaldehyde was adjusted to 1 to 0.55. The pH was adjusted to about 5 in water and the condensation was carried out for about 6 hours at 120° C. The product is then cooled down to 70° C. and bleached with zinc formaldehyde sulfoxylate for 60 minutes. After bleaching, the liquid is a pale amber color instead of very dark brown. The solid content is adjusted to 40%, by weight.

The semi bleaching method of the sulfonated aromatic condensation products of this invention was described in U.S. Pat. No. 5,457,259, Trichromatic Carpet Inc.

Test Methods

In the test procedures and examples described below all percentages are by weight unless otherwise indicated, the molecular weight (MW) is the weight average molecular weight, and the molecular weight (MN) is the number average molecular weight.

Initial Stain Resistance ("IS")

A 5"×5" sample of the substrate to be tested is placed on a flat, non-absorbent surface. A two inch diameter ring is placed on the sample and 20 ml of staining solution is poured into the ring and worked into the substrate. The ring is removed and the sample is left undisturbed for 16 hours at ambient temperature. The staining solution is prepared by dissolving 0.6 grams of Acid Red Dye No. 40, the sample is rinsed with cool tap water and dried.

The stain resistance of the sample is visually rated by assessing the amount of color remaining in the stained area by comparison with the unstained portion. The sample is rated on a scale from 1 to 8 wherein 8 is excellent stain resistance and 1 is poor stain resistance categorized as follows:

8=EXCELLENT STAIN RESISTANCE

7=GOOD STAIN RESISTANCE

6=POOR STAIN RESISTANCE

5=UNACCEPTABLE STAINING

4=UNACCEPTABLE STAINING

3=UNACCEPTABLE STAINING

2=UNACCEPTABLE STAINING
1=UNACCEPTABLE STAINING

After Wet Cleaning Stain Resistance ("WS")

The sample to be tested is first immersed in a detergent solution containing 15 grams of DUPONOL WAQE (Trade Mark of E.I. DuPont de Nemours a surface active agent based on lauryl sulfate) per liter of water at a pH of 10 and at 20° C. for 15 minutes. The sample is removed from the detergent solution and rinsed thoroughly with cool tap water and dried. The staining solution is then applied and evaluated as set out in the initial stain resistance procedure.

Initial Yellowing (Discoloration) Evaluation ("ID")

In the examples a graduated scale from 1 to 5 was used to evaluate yellowing where 5 represents no yellowing. 4 represents acceptable yellowing and 3 or less represents unacceptable yellowing.

Discoloration upon Exposure to Light ("LD")

In the examples a graduated scale from 1 to 5 was used to evaluate discoloration upon exposure to light where 5 represents no discoloration. 4 represents acceptable discoloration and 3 or less represents unacceptable discoloration. Exposure to light was carried out according to AATCC test method 16E with an exposure time of 40 standard hours.

The sulfonated aromatic Condensation Products C and D before bleaching and after bleaching were tested separately and in combination with the Polymers A and B as follows:

EXAMPLES

1) Test on Nylon 66

The treatment bath was adjusted to pH 1.8 by Bartex C-4 (Trademark for buffering system in liquid form of Trichromatic Carpet Inc. under U.S. Pat. No. 5,821,177).

The amount of stainblocker used were as follow:

Example # 1

4 g/L condensation product #C unbleached manufactured by the Second Method (hereinbefore)

Example # 2

4 g/l condensation product #C bleached manufactured by the Second Method (hereinbefore)

Example # 3

4 g/L condensation product # D unbleached

Example # 4

4 g/l condensation product # D bleached

Example # 5

8 g/L methacrylic acid polymer with MW 10,000

Example # 6

6 g/L Polymer A-2 g/L, Polymer B

Example #7

8 g/L Polyacrylic acid polymer with MW 100,000

Example # 8

6 g/L Polymer A-2 g/L condensation product #C bleached manufactured by the Second Method (hereinbefore)

Example # 9

6 g/L Polymer A-2 g/L condensation product #D

Example # 10

6 g/L polyacrylic acid polymer with MW 100,000-2 g/L condensation product #C bleached manufactured by the Second Method (hereinbefore)

2) Test on Nylon 6

The treatment bath was adjusted to pH 2.2 by Bartex C-4 (Trademark for buffering system from Trichromatic Carpet under U.S. Pat. No. 5,821,177).

The amount of stainblocker used were as follows:

Example # 11

8 g/L condensation product #C unbleached manufactured by the Second Method (hereinbefore)

Example # 12

8 g/L condensation product #C bleached manufactured by the Second Method (hereinbefore)

Example # 13

8 g/L condensation product #D unbleached

Example # 14

8 g/L condensation product #D bleached

Example # 15

18 g/L methacrylic acid polymer with MW 10,000 and MW 2,300

Example # 16

14 g/L Polymer A-4 g/L Polymer B

Example # 17

18 g/L polyacrylic acid polymer with MW 100000

Example # 18

14 g/L Polymer A-4 g/L condensation product # C bleached manufactured by the Second Method (hereinbefore)

Example # 19

14 g/L Polymer A-4 g/L condensation product #D bleached

Example # 20

14 g/L acrylic acid polymer MW 100000-4 g/L condensation product #C bleached manufactured by the Second Method (hereinbefore).

In each case Nylon 66 substrate was immersed in the stain resist bath to obtain a pick up of about 350% on the weight of the substrate, then steamed for 3 minutes, followed by light rinse and dried to be ready for testing. The results appear in Table #1:

TABLE # 1

| Product | IS | WS | ID | LD |
|---|---|---|---|---|
| SAMPLE #1 | 7-8 | 6-7 | 3-4 | 3 |
| SAMPLE #2 | 7-8 | 6-7 | 4-5 | 4-5 |
| SAMPLE #3 | 6-7 | 5-6 | 3-4 | 3 |
| SAMPLE #4 | 6-7 | 5-6 | 4 | 4 |
| SAMPLE #5 | 7 | 5 | 5 | 5 |
| SAMPLE #6 | 7-8 | 6-7 | 5 | 5 |
| SAMPLE #7 | 4 | 2 | 5 | 5 |
| SAMPLE #8 | 8 | 7 | 5 | 5 |
| SAMPLE #9 | 8 | 7 | 4-5 | 4-5 |
| SAMPLE #10 | 6 | 5 | 5 | 5 |

In each case Nylon 6 substrate was immersed in the stain resist bath to obtain a pick up of 350% on weight of the substrate, then steamed for 3 minutes, followed by light rinse and dried to be ready for testing: The results appear in Table #2:

TABLE ∩2

| Product | IS | WS | ID | LD |
|---|---|---|---|---|
| SAMPLE #11 | 7 | 6 | 3-4 | 3-4 |
| SAMPLE #12 | 7 | 6 | 4-5 | 4-5 |
| SAMPLE #13 | 7 | 6 | 3 | 3 |
| SAMPLE #14 | 7 | 6 | 4 | 4 |
| SAMPLE #15 | 6 | 4 | 5 | 5 |
| SAMPLE #16 | 7 | 6-7 | 5 | 5 |
| SAMPLE #17 | <3 | <1 | 5 | 5 |
| SAMPLE #18 | 7-8 | 6-7 | 5 | 5 |
| SAMPLE #19 | 8 | 6-7 | 4-5 | 4-5 |
| SAMPLE #20 | <5 | <4 | 5 | 5 |

CONCLUSION

The results in Table #1 and Table #2 of stain resist on Nylon 66 and Nylon 6 show the following:

1. Best results of stainblockers with wash durability treated with acrylic resin alone are obtained from Polymer A and Polymer B of this invention.
2. The low molecular weight methacrylic acid polymer has acceptable effect on the initial staining but it easily removed in alkaline wash.
3. The poly acrylic acid polymer alone has a very little effect or no effect as stain blocker.
4. The bleached condensation product #C of this invention produces best results as stain blocker initially and after alkaline wash alone or in combination with Polymer A in all the examples of this invention on Nylon 66 beside the improved light fastness.
5. Optimum results for initial staining, durability to alkaline wash, and light fastness were obtained by the synergetic effect of the Polymer A and the bleached Condensation Product #C or D.

In this Specification, unless indicated otherwise amounts in parts or by % are by weight.

While the invention has been particularly described by reference to a fibrous polyamide substrate, it applies equally to a wool substrate for the application of the condensation products.

It will be recognized that various modifications and alterations of the invention will be apparent to those skilled in the art without department from the scope and spirit of the invention and that the invention is not restricted by the details and examples set forth for illustrative purposes.

I claim:

1. A method of imparting stain resistance to acid colorants, to a fibrous polyamide or wool substrate comprising:

contacting said substrate with a semi-bleached to bleached sulfonated aromatic condensation resin in an aqueous vehicle, said resin being selected from the group consisting of condensation products of:

i) phenolsulfonic acid, dihydroxydiphenyl sulfone and an aldehyde;

ii) sulfonated dihydroxydiphenylsulfone, dihydroxydiphenyl sulfone and an aldehyde;

iii) sulfonatecl dihydroxy diphenyl sulfone and an aldehyde; and iv) mixtures of i), ii) and iii);

said aqueous vehicle further containing a semi-soluble methacrylic acid polymer having a weight average molecular weight of 100,000 to 500,000 and a number average molecular weight of 50,000 to 100,000, said methacrylic acid polymer being semi-soluble such that it is rendered resistant to wet cleaning processes thereby pipducing durable stain resistance, while providing initial stain resistance prior to wet cleaning of the substrate.

2. A method according to claim 1, wherein said substrate is a polyaxnide substrate.

3. A method according to claim 1, wherein said vehicle further contains a semi-soluble or insoluble ethylmethacrylate polymer having a weight average molecular weight of 100,000 to 500,000 and a number average molecular weight of 25,000 to 100,000, said ethyl methacrylate polymer being semi-insoluble such that it is rendered resistant to wet cleaning processes.

4. A method according to claim 3, wherefn said vehicle further contains an anionic or non-ionic fluorochemical.

5. A method according to claim 1, wherein said resin is a condensation product of 4,4-dihydroxy diphenyl sulfone, sulfonated 4,4-dihydroxy diphenyl sulfone and an aldehyde.

6. A method according to claim 1, wherein said resin is a condensation product of phenol sulfonic acid, 4,4-dihydroxy diphenyl sulfone and an aldehyde.

7. A method according to claim 1, wherein said resin is a condensation product of sulfonated 4,4-dihydroxydiphenylsulfone and an aldehyde.

8. A method according to claim 1, wherein said substrate is a wool substrate.

9. A method according to claim 1 wherein said methacrylic acid polymer has a weight average molecular weight of 150,000 to 250,000 and a number average molecular weight of 50,000 to 80,000.

10. A method according to claim 3 wherein said methacrylic acid polymer has a weight average molecular weight of 150,000 to 250,000 and a number average molecular weight of 50,000 to 80,000.

11. A method according to claim 3 wherein said ethylmethacrylate polymer has a weight average molecular weight of 100,000 to 250,000 and a number average molecular weight of 35,000 to 70,000.

12. A method according to claim 10 wherein said ethylinethacrylate polymer has a weight average molecular weight of 100,000 to 250,000 and a number average molecular weight of 35,000 to 70,000.

13. A method according to claim 1 wherein said polymer is a copolymer of methacrylic acid and a comonomer selected from one or more of the following comonomers 2-ethyl hexyl methacrylate. ethyl metliacrylate, ethyl acrylate, methyl methacrylate, butyl methacry ate or isobutyl methacrylate.

14. A method according to claim 3 wherein said ethyl methacrylate polymer is an ethyl methacrylate copolymer or homopolymer.

15. A method according to claim 3 wherein said ethyl xnethacrylate polymer is a copolymer of ethyl methacrylate and one or more of the following comonomers: ethyl acrylate, 2 ethyl hexyl methacrylate, butyl methacrylate, methyl inethacrylate or isobutyl methacrylate.

16. A method according to claim 1 wherein said substrate is additionally contacted with a blended aldehyde condensate of a naphthalene sulfonic acid.

17. A method acc9rding to claim 1 wherein said substrate is a fibrous polyamide substrate.

18. A method according to claim 1, wherein said condensation resin is bleached or semi-bleached to reduce colour, which causes yellowing, by 20 to 80%.

19. A method according to claim 18, wherein the condensation resin is bleached or semi-bleached with sodium or zinc formaldehydc sulfoxylate.

20. A method according to claim 3, wherein said condensation resin is bleached or semi-bleached to reduce colour, which causes yellowing, by 20 to 80%.

21. A method according to claim 19, wherein the condensation resin is bleached or semi-bleached with sodium or zinc formaldehyde sulfoxylate.

* * * * *

UNITED STATES PATENT AND TRADEMARK OFFICE

CERTIFICATE OF CORRECTION

PATENT NO. : 7,279,013 B2
APPLICATION NO. : 10/872394
DATED : October 9, 2007
INVENTOR(S) : Yassin M. Elgarhy It is certified that error appears in the above-identified patent and that said Letters Patent is hereby corrected as shown below:

In claim 1, col. 12, line 14, delete “sulfonatecl” and insert therefor --...sulfonated...--;

In claim 2, col. 12, line 27, delete “polyaxnide” and insert therefor --...polyamide...--;

In claim 15, col. 13, line 8, delete “xnethacrylate” and insert therefor --...methacrylate… --;

In claim 15, col. 13, line 11, delete “inethacrylate” and insert therefor --...methacrylate...--;

In claim 17, col. 13, line 15, delete “acc9rding” and insert therefor --...according...--

Signed and Sealed this

Fourth Day of March, 2008

JON W. DUDAS
*Director of the United States Patent and Trademark Office*